US006418601B1

(12) United States Patent
Olden et al.

(10) Patent No.: US 6,418,601 B1
(45) Date of Patent: Jul. 16, 2002

(54) WALL FRAME ASSEMBLY TABLE

(75) Inventors: Marc Olden, Pacific; Glenn R. Moore, O'Fallon; John C. Dean, Lake St. Louis, all of MO (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/547,507

(22) Filed: Apr. 12, 2000

Related U.S. Application Data

(60) Provisional application No. 60/163,427, filed on Nov. 3, 1999.

(51) Int. Cl.[7] ..... B25B 27/14

(52) U.S. Cl. ..... 29/281.3; 144/288; 269/905; 269/296

(58) Field of Search ..... 269/296–299, 269/303, 321, 910, 905, 93, 41, 254 CS, 208, 281.1, 281.4, 281.5, 71; 144/288 R, 288 C; 29/200 P, 281.3

(56) References Cited

U.S. PATENT DOCUMENTS

| | | | | | |
|---|---|---|---|---|---|
| 2,305,124 | A | | 12/1942 | Wilson, Jr. et al. | |
| 2,983,292 | A | | 5/1961 | McKinley | |
| 3,244,416 | A | | 4/1966 | Hollomon | 269/26 |
| 3,255,943 | A | * | 6/1966 | Sanford | 269/910 |
| 3,375,778 | A | * | 4/1968 | Newman | 269/910 |
| 3,699,622 | A | * | 10/1972 | Frydenberg | 29/155 R |
| 3,735,464 | A | * | 5/1973 | Linzmeier | 29/200 |
| 3,904,185 | A | * | 9/1975 | Schneider | 269/910 |
| 3,933,348 | A | * | 1/1976 | Tidwell | 269/296 |
| 4,154,436 | A | | 5/1979 | Sellers | |
| 4,330,921 | A | * | 5/1982 | White | 29/432 |
| 4,383,680 | A | * | 5/1983 | Braceland | 29/281.1 |
| 4,426,759 | A | | 1/1984 | Burger | |
| 5,617,622 | A | * | 4/1997 | Anderson | 29/281.3 |

FOREIGN PATENT DOCUMENTS

| | | |
|---|---|---|
| DE | 198 11 217 | 9/1999 |
| GB | 2 325 427 | 11/1998 |

OTHER PUBLICATIONS

European Patent Office, European Search Report, 2 pages, Nov. 27, 2001.

* cited by examiner

*Primary Examiner*—Joseph J. Hail, III
*Assistant Examiner*—Daniel Shanley
(74) *Attorney, Agent, or Firm*—Senniger, Powers, Leavitt & Roedel

(57) ABSTRACT

A wall frame assembly table for rapid assembly of wall frames at a central location for shipment to a construction site. The wall frame assembly table can be configured for construction of wall frames of different shapes and sizes. The table is constructed to inhibit the accumulation of debris on the table for consistently accurate placement of the wall frame elements. Locating pins along the sides of the table engaging the wall frame elements can be selectively removed as needed for driving nails through the elements. An adjustable support is provided for the top plate of the wall frame which can be extended to different distances from an edge of the table for walls of different height. In addition, the adjustable support can be angled in correspondence with a wall frame which has a top plate extending at an angle relative to the bottom plate. A laser projection system may be used to locate the elements of the wall frame. However, the table may include an offset locator to permit entirely manual setup and assembly with minimal effort and skill.

21 Claims, 14 Drawing Sheets

44
44A
44B
44C
44D
44E
42
34
34A
34B
34C
34D
20
62
62A
62B
64
38
36H
32
8
S
J

WALL FRAME ASSEMBLY TABLE

This is a continuation-in-part of U.S. Provisional patent application Ser. No. 60/163,427, filed Nov. 3, 1999.

BACKGROUND OF THE INVENTION

This invention relates generally to tables or jigs for use in the assembly of framework structures, and more particularly to a table for assembly of wall frames and the like.

The construction industry has long taken advantage of savings and reduction in skill needed for on-site labor associated with pre-manufacture of certain components of structures. For example, it is commonplace for trusses for roofs to be manufactured at a location remote from the construction site and transported to the site for assembly into the structure. It is also known to pre-manufacture the frames for internal walls of the structure. A basic wall frame includes a bottom plate, a top plate and studs extending between the top and bottom plates. Variances in construction are required to accommodate doors, windows or other discontinuities in the wall. Usually, the plates and studs are wooden, although metal wall frame elements are also frequently employed.

Wall frames are often manually assembled on tables having a substantially solid top with some structure at the edge of the table top to locate the bottom plate and the stud defining one side of the wall frame. The workers must read the blueprint showing the construction of the wall frame. The location for connection of studs to the bottom and top plates are measured out and marked on the plates. The wall frame elements are placed on the table and secured together typically by nailing with a nailing gun. Automated machines for assembling wall frames are known, but are generally not cost effective. The use of wood entails the presence of sawdust and wood debris on the table over time. Sawdust and other debris collecting at the edge of the table where the top and bottom plates are located can cause these to be misaligned and produce poor wall frame construction. In some cases, a laser or other projection system is used to project the location of the wall frame elements on the table to require less time to put the wall frame elements in place. Where laser projection systems are used, misalignment of the top or bottom plate will result in the stud location being projected at an incorrect position.

Still further, modem construction, and in particular in the area of residential home building, requires the ability to make many different kinds of wall frames. For instance, where a room is to have a cathedral ceiling, the top plate of the wall frame will not be parallel to the bottom, but instead will be at an angle. The standard table does not provide any ready way to positively locate an angled plate. Moreover, if the height of the wall frame becomes too great for the table because of angulation of the top plate, it may be necessary to build the wall frame in two sections, one being later placed on top of the other.

Laser projection systems provide a most convenient and accurate way to locate wall frame elements on an assembly table. However, some may wish to avoid the additional cost of such a system. Absent the system, it is necessary for the workers to read a blueprint showing the relative position of the wall frame elements and translate this information onto the table for locating the elements. As described above, this task is commonly done with a tape measure and a pencil, requiring a substantial amount of setup time. Although wall frames typically include studs which are spaced at regular (16 or 24 inch) intervals between the top and bottom plates, it is not presently possible to use a fixed location for one end of the wall frame and know where the studs should be located. Each assembled wall frame typically constitutes only one segment of the wall which is to be built. The intersection of adjacent wall frames, for instance at a corner of two walls will often require a non-standard spacing of the studs from the end of the wall. The exterior sheathing of one wall at the corner extends outwardly from the end of the wall by an amount approximately equal to the thickness of the other wall. Because the sheathing comes in standard sizes, it is necessary to space the first stud of the wall from the end closer than the regular spacing to permit the sheathing to be secured to the stud at the correct location. In other instances, the builder may require that all of the opposing studs of opposite walls in the structure be aligned. In order to accomplish this, non-standard spacing from the ends of some wall frames will be necessary. As a result, it is necessary to measure out the precise locations of the studs from a fixed stop on the table for substantially every wall frame formed.

SUMMARY OF THE INVENTION

Among the several objects and features of the present invention may be noted the provision of a table for assembling wall frame which allows the elements to be accurately positioned; the provision of such a table which permits accurate location of elements for wall frames of various configurations; the provision of such a table particularly suited for use with projection systems; the provision of such a table which can be alternatively manually setup with speed and minimal effort and the provision of a table which permits rapid assembly of wall frames.

Further among the several objects and features of the present invention may be noted the provision of a method of setting up a wall frame assembly table which can be carried out rapidly; the provision of such a method which eliminates the number of measurements required for setup; the provision of such a method in which studs are placed without measurement to determine their locations; the provision of such a method which can be carried out without a separate tape measure.

Still further among the several objects and features of the present invention may be noted the provision of a wall frame assembly table which facilitates the objects of the manual setup method.

Generally, a table for assembling wall frames and the like comprises a frame and a work top supported by the frame and adapted to support wall frame elements thereon. The work top has a peripheral edge. Wall frame element supports extending outwardly from the peripheral edge of the work top are sized to support wall frame elements thereon adjacent to the work top. The supports are spaced apart whereby debris in the region of the work top peripheral edge can fall between the supports and is inhibited from accumulating on the supports.

In another aspect of the invention, a table for assembling wall frames and the like comprises a frame and a work top as described. In addition, an adjustable wall frame element support located laterally outwardly from the peripheral edge is mounted on the frame for movement toward and away from the peripheral edge.

In a further aspect of the present invention, a method is disclosed of rapidly assembling wall frames on an assembly table. The wall frames include a bottom plate, a top plate and studs extending between and interconnecting the top and bottom plates. The studs have a predetermined spacing from each other. The table has markings thereon spaced from each other and from a reference location equal to the predetermined spacing of the studs in the wall frame. The method generally comprises the step of locating a first longitudinal end of one of the top and bottom plates on the table at a position between the reference location and the marking nearest to the reference location. The other of the top and bottom plates is placed on the table. The studs are positioned at least at some of the markings on the table between the top and bottom plates between the first longitudinal end and second longitudinal end whereby the studs are located at correctly spaced positions without measurement and marking of the top or bottom plates. The studs are secured to the top and bottom plates.

In yet another aspect of the present invention, a wall frame assembly table for rapidly assembling wall frames generally comprises a table top constructed for supporting at least some of the elements of the wall frame being assembled, the top having opposite edge margins. A reference locator is mounted on the table in a fixed position relative to the table top. Stud locator markings on the table top are positioned at intervals along the top from the reference locator. An offset locator is adapted to be selectively secured at different locations generally along one of the edge margins of the table top. The offset locator is engageable with a longitudinal end of one of the top and bottom plates for locating an end of the wall frame in a position offset from the reference locator a distance spaced from the reference locator which is selected to locate an end of the wall frame to permit placement of studs in the wall frame at the stud locator markings without measurement from the reference locator.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
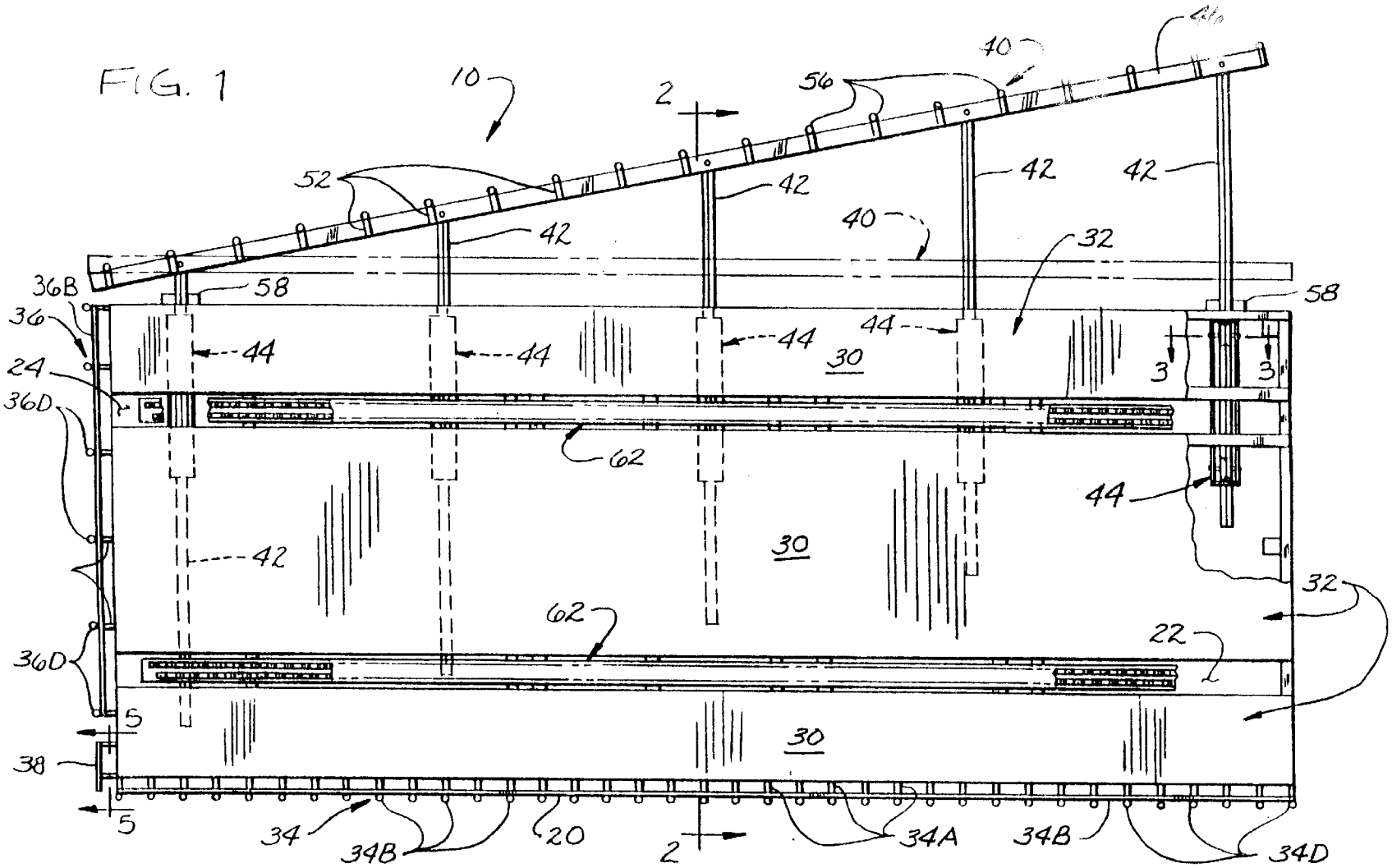
FIG. 1 is a top plan view of a wall frame assembly table.
Figure 6:
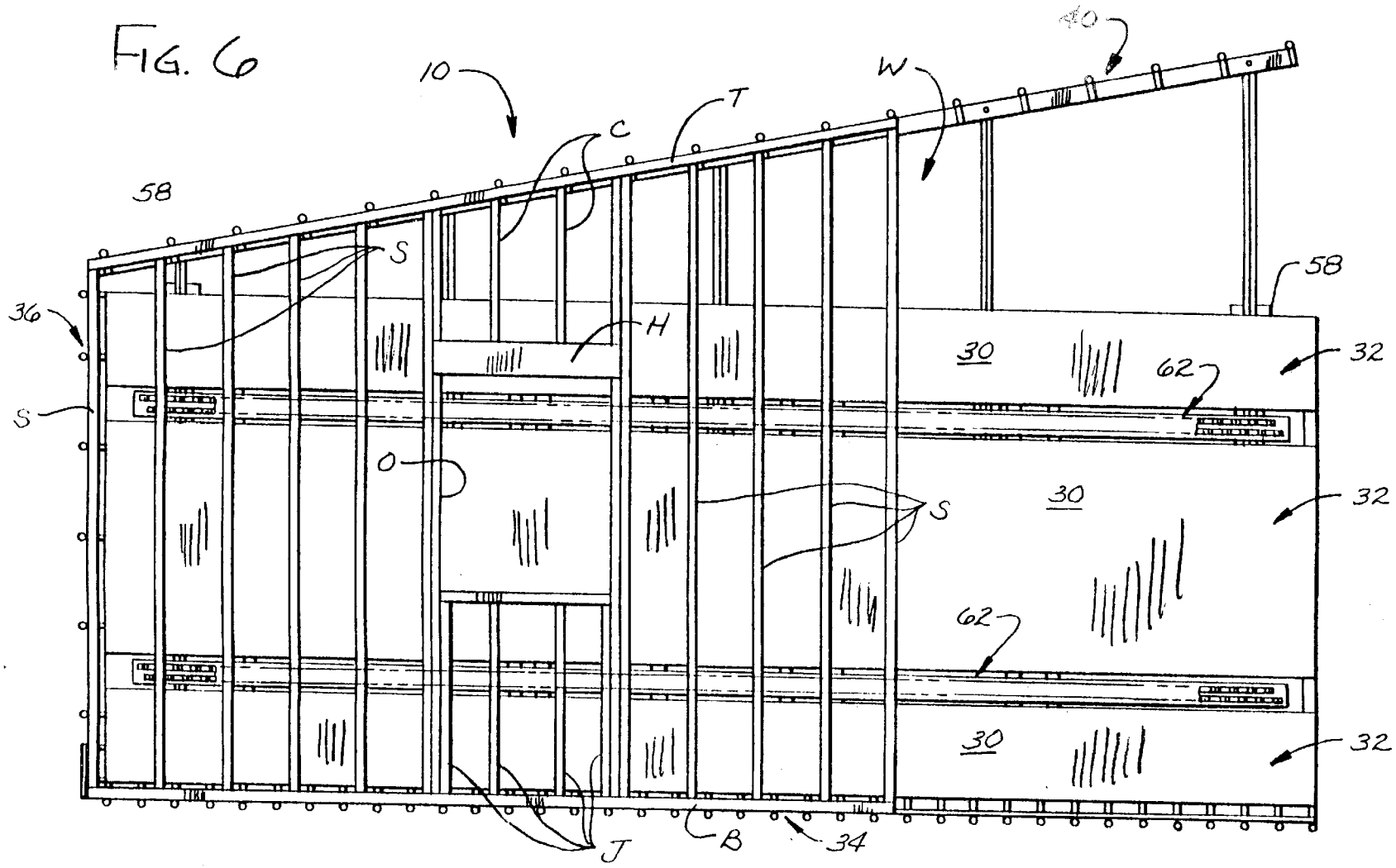
FIG. 6 is the wall frame assembly table of FIG. 1, but showing the location of wall frame components on the table.

Referring now to the drawings, and in particular to FIGS. 1 and 6, a wall frame assembly table of a first embodiment for use in assembling wall frames is designated generally at 10. A wall frame W includes wall frame elements comprising a bottom plate B, a top plate T, studs S, jacks J, cripples C and a header H located between the bottom and top plates. The wall frame W illustrated in FIG. 6 is intended as an example, and includes an opening O for a window. Although the table 10 is particularly adapted for assembly of wall frames, it is to be understood that it may be used to assemble other framework structures without departing from the scope of the present invention.

Figure 2:
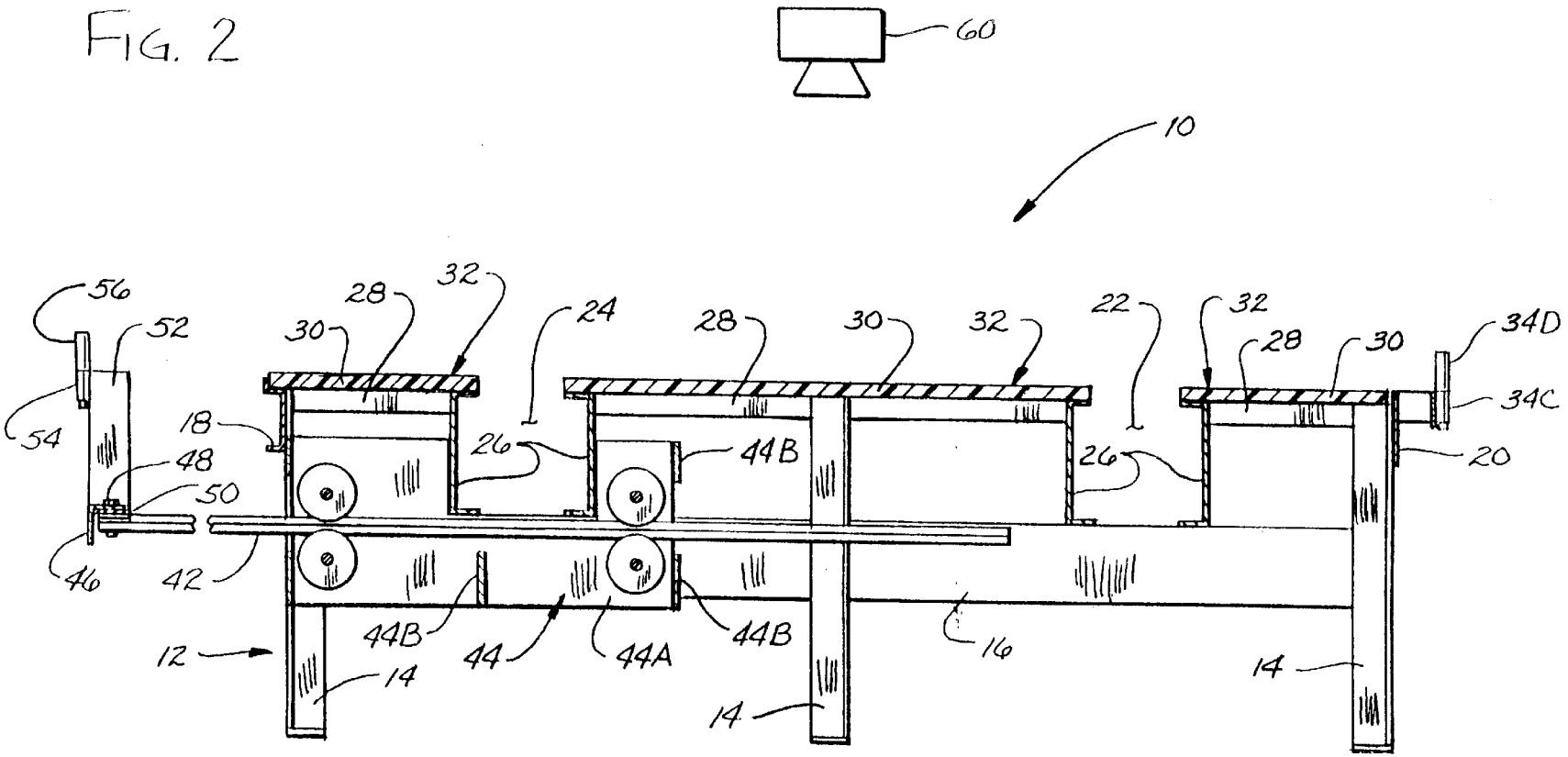
FIG. 2 is a section taken in the plane of line 2—2 of FIG. 1 showing a rail guide and extendable rail of the table and schematically illustrating a projection system used with the table.

The table 10 includes a frame (generally indicated at 12) comprising fifteen legs 14, three of which are shown in FIG. 2. The legs are disposed in groups of three arranged in a line across the width of the table 10, and each group is spaced lengthwise from of the table from the other groups. The legs 14 in each group are connected together by a transverse C-shaped channel 16 extending the width of the table 10. A smaller side C-shaped side channel 18 extending lengthwise connects the legs 14 together along one peripheral edge of the table 10 and a flat side bar 20 extending lengthwise connects the legs together along an opposite peripheral edge. Flat, transversely extending side bars (not shown) are also connected to the longitudinal ends of the table 10. First and second ejector cavities (designated generally at 22 and 24) are formed in the table 10 by respective opposed pairs of C-shaped ejector channels 26. Each ejector channel 26 extends lengthwise of the table and is mounted on the transverse channels. The frame 12 is further rigidified by angles 28 extending transversely of the table 10. Only one group of angles may be seen in the drawings (FIG. 2). The angles 28, like the legs 14 are arranged in groups of three spaced longitudinally of the table 10. The angle groups are located at each longitudinal end of the table 10 and are spaced apart a distance equal to one have the spacing between adjacent leg groups. In each angle group, one angle 28 extends between the side bar 20 and the first ejector cavity 22, a second angle extends between the first ejector cavity and the second 24, and a third angle extends between the second ejector cavity and the smaller side channel 18. The open top of the frame 12 is closed by panels 30 except at the location of the ejector cavities 22, 24 such that the panels define generally smooth work top (generally indicated at 32) of the table 10. The panels 30 are made of suitable material, such as ultra high molecular weight plastic.

Supports projecting laterally outwardly from a lower the peripheral edge (as viewed in FIGS. 1 and 6) of the table work top are indicated generally at 34. The supports are capable of supporting a bottom plate B of the wall frame W. In the illustrated embodiment, the supports 34 are spaced apart about eight inches from each other along the length of the table 10. Each support 34 comprises a support plate 34A welded at one end to the side bar 20. The support plate 34A is oriented vertically and, in the illustrated embodiment, has a length of about three inches. The supports 34 are connected together at their outer ends by a thin, flat tie bar 34B. A tube 34C having an upper end approximately flush with the upper end of the support plate 34A is attached as by welding to the tie bar 34B on an end of the plate opposite the side bar 20. The supports 34 each further includes a pin 34D capable of being slidingly received in the tube 34C. The pin 34D is generally cylindrical and includes an upper portion having a larger diameter than a lower portion of the pin. The lower portion is sized for reception in the tube 34C, and has a length greater than the length of the tube so that a portion projects below the bottom of the tube when the pin is fully seated in the tube. The part extending below the tube 34C can be used to hammer out the pin 34D in the event it becomes stuck in the tube. The upper portion of the pin 34D is larger in diameter than the tube opening so that the upper portion rests on the tube 34C and projects above the tube and support plate 34A. Collectively, the upper portions of the pins define a rigid fence which engages the bottom plate B of the wall frame W to locate the bottom plate and support it against forces directed laterally outwardly of the table 10, such as those forces experienced when the top plate is being nailed to a stud S. The pins 34D are capable of being removed so that if nails are to be driven through the bottom plate B at a location where a pin is located, the pin can be removed to provide access to the bottom plate.

Figures 2A, 3, 4, 5, 7, 8:
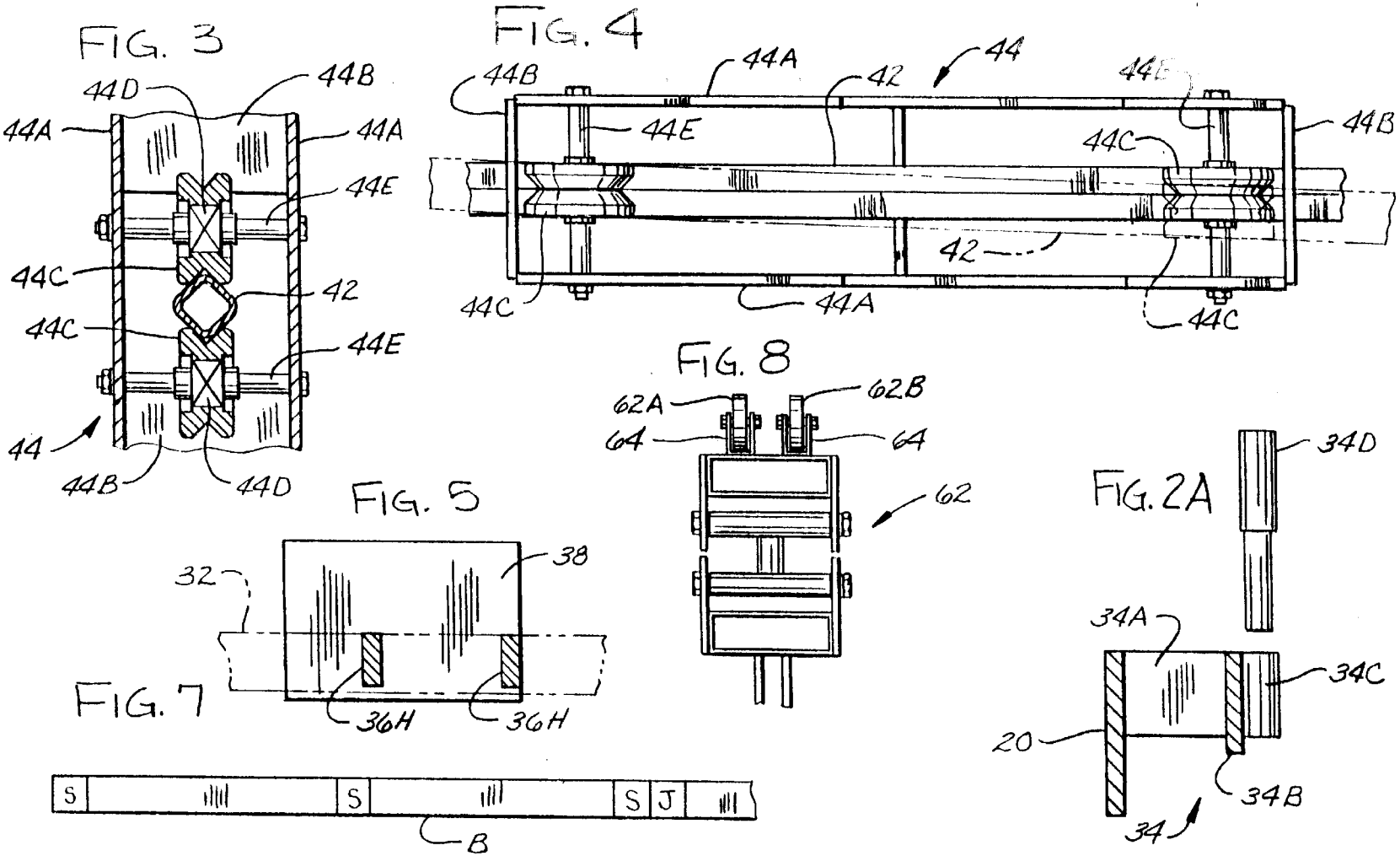
FIG. 2A is an enlarged fragmentary view of a wall frame lower plate support of the table.
FIG. 3 is a fragmentary end elevational view of the rail guide seen as indicated by line 3—3 of FIG. 1.
FIG. 4 is a top plan view of the rail guide.
FIG. 5 is a section taken in the plane of line 5—5 of FIG. 1 and illustrating a stop for locating an end of a bottom plate of a wall frame.
FIG. 7 is an enlarged, fragmentary view of a bottom plate of the wall frame with projected markings thereon.
FIG. 8 is an end elevation of an ejector of the table.

Supports, generally indicated at 36, also project laterally outwardly from a left side peripheral edge of the table work top 32 (as viewed in FIG. 1). These supports 36 have the same construction (including tie bar 36B and removable pins 36D) as the supports 34 on the lower edge of the work top. However, the supports 36 are spaced at sixteen inch intervals rather than eight inch intervals in the illustrated embodiment. The spacing of the supports 34, 36 can be changed from the preferred embodiment without departing from the scope of the present invention. The supports 36 hold a stud S defining the left end of the wall frame W and the pins 36D provide location and a reaction surface for that stud. An end stop 38 located at the corner of the left side peripheral edge and the bottom peripheral edge locates the left end of the bottom plate B. The end stop 38 comprises a plate which is attached by two support plates 36A to the table frame 12. As shown in FIG. 5, the end stop 38 projects above the plane of the work top 32 of the table 10.

An adjustable support, indicated generally at 40, is located adjacent to an upper peripheral edge of the table work top 32. The adjustable support 40 is adjustable to position the top plate T both for changing the height of the wall frame W and for changing the angle the top plate makes with the bottom plate B, or some combination of height and angulation. The support 40 includes five rails 42 mounted on the frame 12 by rail guides (generally indicated at 44) for movement perpendicularly to the upper peripheral edge (as seen in FIG. 1) of the table work top 32. The free ends of the rails 42 are tied together by an angle iron 46 pivotally attached to each rail by a pivot bolt 48 (FIG. 2). More specifically, each rail 42 has a small platform 50 welded to the top of the rail at its free ends and the pivot bolt 48 passes through the small platform and the angle iron 46. Upstanding support plates 52 are attached as by welding to the angle iron 46 and project up to a plane approximately coincident with the plane of the work top 32 of the table 10. The spacing of the upper support plates 52 from each other is approximately sixteen inches in the preferred embodiment. The upper edges of these support plates 52 support the top plate T of the wall frame W (FIG. 6). Vertically oriented tubes 54 welded to the outer edges of the support plates 52 have an upper end generally flush with the upper edge of the support plate. The tubes 54 receive pins 56 having the same construction as the pins 34D used along the lower peripheral edge of the table 10. The pins 56 can be removed as needed to drive nails through the top plate T into a stud S or other wall frame element.

The rails 42 are square tubes which are turned on one corner and received in respective rail guides 44. Referring to FIGS. 2–4, the rail guides 44 each comprise an opposed pair of mounting plates 44A, each having a square cutout in an upper edge thereof to receive the channels 26 forming one of the ejector cavities 22, 24. The mounting plates 44A are joined to each other by cross plates 44B connected in transversely spaced locations to the frame 12. Four bogies 44C are mounted between the mounting plates 44A by bearings 44D on a shaft 44E for free rotation about a horizontal axis. The bogies 44C are each V-shaped in cross section for receiving the rails 42 turned on one corner. Two of the bogies 44C in each rail guide 44 engage the top of the rail 42 and two engage the bottom. The bogies 44C support the rails 42 in the rail guides 44 so that they can be easily manually moved in an out to position the support plates 52 and pins 56 as desired.

Figure 9:
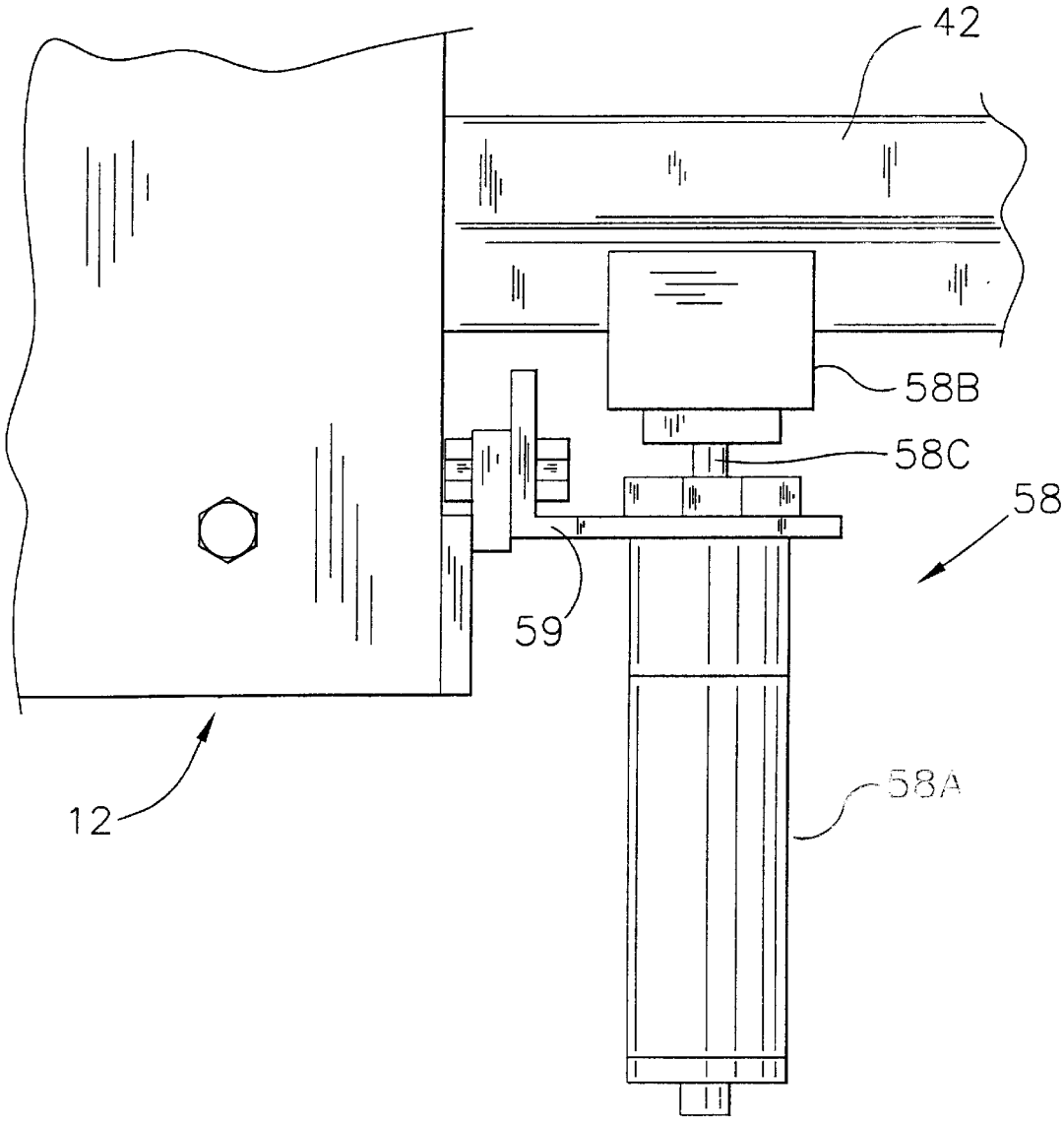
FIG. 9 is an enlarged fragmentary end elevation of the top right end of the table as shown in FIG. 1 showing an air brake.

The pivot connection of the angle iron 46 to the rails 42 permits the angle iron, support plates 52 and pins 56 supported by it to be turned at an angle to the peripheral edge of the table work top 32. The positioning of the adjustable support 40 in an angled configuration is illustrated in solid lines in FIG. 1. As may be seen the rails 42 extend from under the table 10 different distances to produce the angle. It is also necessary that the rails 42 be permitted to pivot somewhat in the rail guides 44 to accommodate the angulation. To that end, the inner bogies 44C (i.e., the bogies farther from the peripheral edge of the table) are mounted on the shafts 44E for sliding lengthwise of the shafts. Thus, as the rails 42 pivot relative to the rail guides 44, the inner bogies 44C may slide along the shaft 44E to accommodate the pivoting as illustrated in phantom in FIG. 4. The outer bogies 44C are fixed on their corresponding shafts 44E. The V-shape of the bogies 44C also helps the rails 42 to assume an angle without jamming or affecting ease of movement in the rail guides 44. Once in position, the adjustable support 40 is locked by air brakes 58 which apply a gripping force to the left and right hand rails 42 (as seen in FIG. 1). Additional details of construction of the air brakes 58 are shown in FIG. 9. More particularly, it may be seen that each air brake 58 comprises a double acting cylinder 58A having a V-shaped saddle 58B attached to the end of the rod 58C of the cylinder. The cylinder is mounted by a bracket 59 on the frame 12 of the table 10. To lock the rails 42 of the adjustable support 40, the cylinder 58A is extended to force the saddle 58B against the rail, locking it in a fixed position relative to the table 10 and work top 32. The adjustable support 40 is shown in phantom in FIG. 1 in a configuration parallel to the supports 34 and the lower peripheral edge.

Referring now to FIGS. 2 and 7, a laser projection system 60 is preferably provided in conjunction with the table 10 for projecting the location of the wall frame elements, including the top and bottom plates T, B, the studs S, but also including other conventional elements such as jacks J, cripples C and headers H. The location for the studs S, jacks J, cripples C and headers H is projected onto the bottom plate B, as shown in FIG. 7, and also onto the top plate T. The provision of the supports 34, 36, 40 of the present invention substantially prevent the accumulation of debris under the location where the top and bottom plates T, B and leftend stud S are to be placed. Any debris falls between the spaced apart support plates 34A, 36A, 52 so that it cannot accumulate. Thus, the top and bottom plates T, B and leftend stud S can be accurately placed for each and every wall frame assembly, and the projection system 60 is able to accurately project locating information onto the top and bottom plates. In the illustrated embodiment, the projection system 60 is the PanelLine™ projection system manufactured by Virtek Vision Corporation of Waterloo, Ontario, Canada and available commercially from MiTek Industries, Inc. of St. Louis, Mo.

Ejectors received in respective ejector cavities 22, 24 are designated generally at 62. The ejectors are disposed below the work top 32 of the table 10 during assembly of the wall frame W. The ejectors 62 are generally of conventional construction, being driven by an air cylinder (not shown) to extend up above the work top 32 to lift the wall frame W off of the work top. The ejector 62 has rollers 62A, 62B (FIG. 8) which engage and support the wall frame so that is can be rolled to one side off of the work top 32. The rollers 62A, 62B are mounted in respective channels 64. One difference from the standard ejector is that each ejector has two side-by-side rows of rollers 62A, 62B. The rollers in each row are longitudinally offset from the rollers in the other row to provide more support for the wall frame W. Otherwise, there may be a tendency for the wall frame to bounce as it is rolled off the ejector 62 because the studs S have only very thin surfaces engaging the rollers. This is undesirable because the wall frames W tend to be relatively fragile prior to installation is a structure. The offset rows of rollers 62A, 62B are able to smoothly roll the wall frame off of the ejector 62.

In a preferred embodiment, the table 10 of the present system can be used as part of an integrated manufacturing system in which engineering designs for the wall frame W are computer generated. The computer-based information can be fed to an automated saw (not shown) to cut all of the wood elements needed to assemble the wall frame. The elements can be assembled and delivered to the table 10 for assembling the wall frame W. It is to be understood that the table 10 can be used without automation of the type described, or without the projection system 60 while retaining substantial advantages in labor savings and flexibility. In the illustrated embodiment, the projection system 60 is capable of projecting the entire wall frame W on the table 10, or only the locations of connection of the studs S, jacks J, etc. to the top and bottom plates T, B (as shown in FIG. 7). Referring to FIG. 6, the bottom plate B is placed on the supports 34 at the bottom peripheral edge of the table work top 32. The support plates 34A engage the bottom plate B at spaced apart locations and the engagement occurs over the relatively thin upper edge of the support plates. Thus, sawdust and other debris generated during repeated wall frame assembly falls easily between the support plates 34A and does not accumulate where the bottom plate B is supported so that the bottom plate lies flat on the supports 34. This is also true for the stud S supported on the supports 36 adjacent the left peripheral edge of the work top 32 and the top plate supported on the adjustable support 40. The adjustable support is pulled out to make the angle shown in FIG. 6. The rails 42 are manually slid out of the rail guides 44 on the bogies 44C different distances from the top peripheral edge of the work top 32 to form the angle of the adjustable support 40. The angle iron 46 pivots on the free ends of the rails 42 as needed to accommodate the angle. The air brakes 58 are activated to lock the adjustable support 40 in position once it is in place.

An example of the projection system 60 projecting lines and code letters for location of studs ("S") and jacks ("J") onto the bottom plate B is shown in FIG. 7. As previously stated, the projection system 60 may project the entire outline of the various wall frame elements on the table 10 or only certain portions. The wall frame elements are placed on the work top 32 according to the positions indicated by the projection system. It is unnecessary for the laborers to read a blueprint or to measure and mark locations for the elements of the wall frame W between the top and bottom plates T, B. A laborer using a nail gun (not shown) drives nails into the top and bottom plates to secure studs S and other wall frame elements to the plates. The locations for driving the nails are projected onto the top and bottom plates T, B by the projection system. If any pin 34D, 36D, 56 of the supports 34, 36, 40 overlies a region of the top or bottom plate T, B (or the stud S on the left end of the wall frame W) where nails are to be driven through the plate into the stud or other wall frame element, that pin can be removed by sliding out of the tube to provide unobstructed access to the top or bottom plate. Thus, it may be seen that easy and rapid assembly of wall frames can be carried out with the table 10 of the present invention. Even if the projection system 60 is not used, the table 10 facilitates rapid assembly of wall frames. Moreover, the table 10 can be rapidly adjusted to accommodate wall frames of different configurations.

Referring now to FIGS. 10–17, a second embodiment of the wall frame assembly table of the present invention for manual set up and location of wall frame elements is designated generally by the reference numeral 110. Parts of the wall frame assembly table of the second embodiment corresponding to those of the first embodiment will be designated by the same reference numeral with the addition of the prefix "1". Additional parts found only in the second embodiment will be numbered in a 200 series. The corresponding parts will not be described in detail for the second embodiment, having previously been described above for the first embodiment. In particular, the construction and operation of the adjustable support 140 is substantially unchanged from that described in the first embodiment. The supports 134 and 136 are also substantially unchanged. However, it has been found that the tie bar 34B and the tie bar 36B are not necessary and have been omitted and that the number of supports 134, 136, 152 may be reduced. As explained more fully below, the wall frame assembly table 110 of the second embodiment includes features to facilitate rapid manual setup and placement of wall frame elements in the absence of the laser projection system 60.

Figure 10:
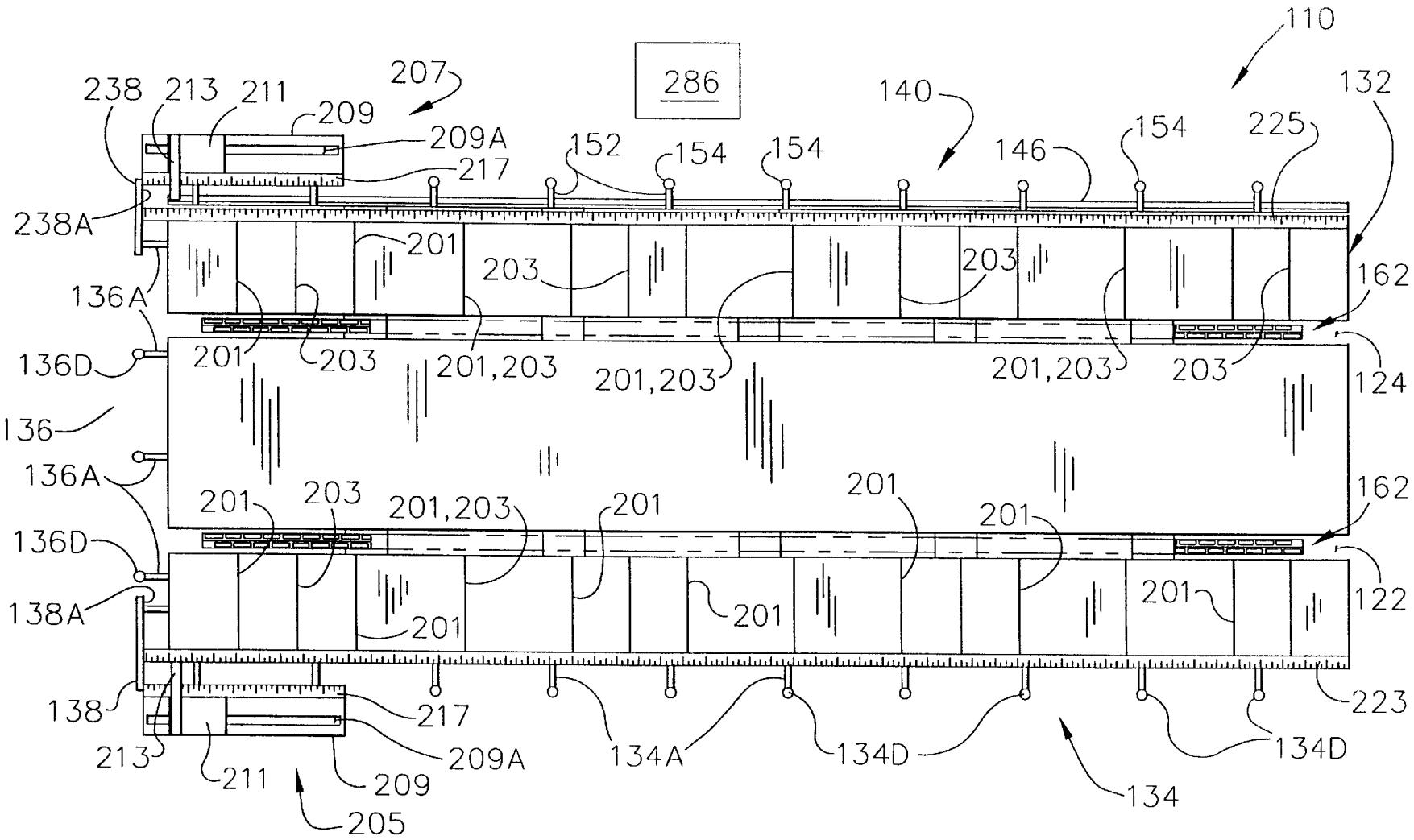
FIG. 10 is a top plan of a wall frame assembly table of a second embodiment.

As shown in FIG. 10, the wall frame assembly table 110 includes a second end stop 238 in addition to the end stop 138 for locating the left (as viewed in FIG. 10) end of the wall frame W (shown in FIG. 12) to fix the lateral location of the top and bottom plates T, B on the left side. Each end stop 138, 238 is a metal plate attached as by welding to the distal ends of two support plates 136A (only one support plate for each end stop may be seen in FIG. 10). The fixed end stops 138 and 238 are broadly, "reference locators", having permanently fixed positions relative to the work top 132 of the table 110 and establishing a "zero" reference position for the table in relation to which all wall frame elements are positioned. The work top 132 of the table 110 is scored transversely with grooves (broadly, "stud locator markings"), which are spaced at about 16 and 24 inch intervals from the reference locators along the full length of the table. The 16 inch interval grooves are designated 201 and the 24 inch interval grooves are designated 203. The work top 132 is formed of three segments separated by cavities 122, 124 in which the ejectors 162 are received. The grooves 201, 203 in the illustrated embodiment are formed only in the two outer segments of the work top 132, but could be formed on any one or all of the segments without departing from the scope of the present invention. In actual practice the first two stud locator grooves 201, 203 to the right of the end stops 138, 238 are spaced about 15¼ inches and 23¼ inches, respectively, from the end stops. The remaining grooves 201, 203 are spaced at regular 16 and 24 inch intervals from the first grooves. The location of the first grooves 201, 203 allows the outside face of the 2×4 studs S, oriented on edge in the wall frame W, to be lined up with the grooves so that the center to center spacing of the studs is 16 (or 24) inches.

The grooves 201, 203 indicate the proper position of studs S in the wall frame W, and the intervals constitute the standard spacing of studs for walls used in construction. However, it is to be understood that the spacing intervals could be other than described without departing from the scope of the present invention. Grooves 201, 203 located at positions which are spaced by common multiples of 16 and 24 from the end stops 138, 238 may be indicated by making the groove wider, or in other ways. It is envisioned that the 16 and 24 inch grooves 201, 203 generally might be distinguished by giving the grooves different widths or different colors to further simplify use of the table 110. It is also envisioned that stud locator markings could be made otherwise than by scoring the table work top 132, including by tape, painted line, or raised line. However, scoring is preferred because it is not as readily subject to being worn off and does not interfere with elements of the wall frame W placed on the work top 132. In instances where a basic wall frame having no windows, doors or other discontinuities is to be assembled (e.g., as for wall frame W" shown in FIG. 18B), the top plate T can be supported on the adjustable support 140, the bottom plate B on the supports 134 and the left end stud S on the supports 136. The remaining studs S can simply be placed between the top and bottom plates T, B in alignment with the grooves (201 or 203) to complete the wall frame W". No measurements are required to position all of the elements of the wall frame W".

Figure 14:
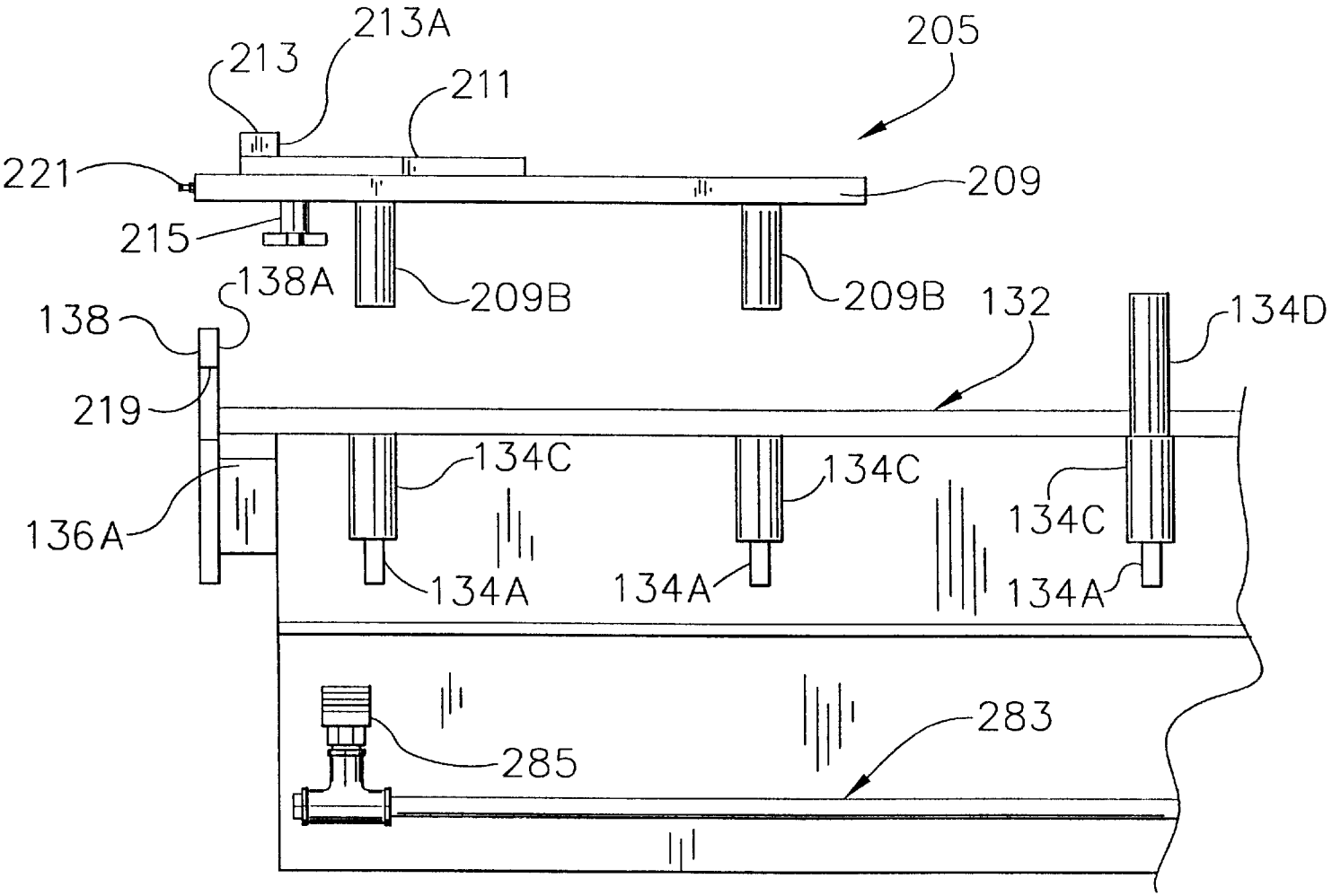
FIG. 14 is an enlarged, fragmentary elevation of the corner shown in FIG. 13.

However, where at least one stud S must be placed at a non-standard spacing from the left end of the wall frame W, the table 110 permits relocation of the left end of the wall frame so that the grooves 201, 203 may still be used to position the studs. In that regard, offset locators indicated generally at 205, 207 are connected to the table 110 at the lower and upper (as viewed in plan in FIG. 10) edge margins near the left end of the table. Each offset locator 205, 207 comprises a base 209 having an elongate slot 209A and a pair of legs 209B (FIG. 14) depending from an underside of the base. The offset locators 205, 207 are of substantially identical construction, one being substantially the mirror image of the other. Thus, details of construction will be given only for the offset locator 205 at the lower left end of the table 110 as seen in FIG. 10. As best illustrated in FIG. 14, the legs 209B of the base 209 are adapted for reception in tubes 134C provided on the table 110 for receiving pins 134D to removably mount the offset locator 205 on the table. However, it is to be understood that one or both of the offset locators 205, 207 could be permanently affixed to the table 110 without departing from the scope of the present invention. As mounted on the table 110, the left edge of the base 209 of the offset locator 205 is substantially aligned with an inner face 1 38A of the end stop 138. The offset locator 205 further includes a stop comprising a slide 211 fixedly mounting a locating finger 213 engageable with the left end of the bottom plate B to locate the left end of the wall frame W. The slide 211 includes a portion received in the slot 209A and a bolt (not shown) projecting down below the slot. A set knob 215 is threadably received on the bolt and positioned for engaging the underside of the base 209 to fix the slide 211 in a selected position on the base by clamping engagement with the base. When the knob 215 is turned to release its grip on the base, the slide 211 and locating finger 213 are free to slide along the slot 209A.

A longitudinal edge margin of the base 209 of the offset locator 205 which is closest to the table 110 is formed with a rabbet along its entire length. A tape measure 217 (broadly, a "rule") is mounted on the base 209 in the rabbet below the level of the slide 211 and out of engagement with either the slide or the locating finger 213. The tape measure 217 is aligned at one end with the inner face 138A of the end stop 138 and extends parallel to the edge of the work top 132 for use in positioning the locating finger 213. A rule could be formed on the base 209 by structure other than a tape measure without departing from the scope of the present invention. For instance, graduations could be marked on or scored into the material of the base in place of affixing a tape measure. It is also envisioned that a rule on the table 110 could be used in place of the tape measure 217 on the base 209. The locating finger 213 extends inwardly across the tape measure 217 and over the supports 134. The locating finger is positioned by aligning an inner face 213A of the finger, which is positioned to engage the bottom plate B at a position spaced inwardly of the end stop 138, with a marking on the tape measure 217. In the preferred embodiment, the inner face 213A of the locating finger 213 constitutes an indicator for indicating the position of the stop relative to the tape measure 217. However, other structure separate from the locating finger 213 could be employed for making the indication of position. The knob 215 is screwed up against the base 209 to fix the slide 211 and hence the locating finger 213 at the selected location. The same alignment procedure for the top plate T can be carried out with the offset locator 207 on the opposite edge of the table 110.

Each of the end stops 138, 238 is formed with an opening 219 which permits the locating finger 213 to pass substantially through the end stop so as not to interfere with engagement of the bottom or top plate B, T with the end stop when no offset is required. Referring again specifically to the offset locator 205, preferably the inner face 213A of the finger is made flush with the inner face 138A of the end stop 138, thereby to form a substantially continuous surface with the inner face of the end stop for engagement with the left end of the bottom plate B. The flush position of the offset locator 205 is illustrated in phantom in FIG. 13. A positioning bolt 221 in the end of the base 209 extends into the slot 209A to engage the slide 211 for positioning the inner face 213A of the locating finger 213 flush with the inner face 138A of the end stop 138 when the finger is withdrawn into the opening 219 in the end stop. Manipulation of the positioning bolt 221 permits the relative position of the inner face 138A of the end stop and inner face 213A of the locating finger 213 to be changed to achieve generally flush alignment.

In order to position elements of the wall frame W which are not located precisely at one of the offset locators 205, 207 or any of the stud locator grooves 201, 203, tape measures 223, 225 (broadly, "reference rules") are affixed to the table 110 along the top and bottom (as seen in FIG. 10) edge margins of the work top 132 of the table. The edge margins of the work top 132 immediately adjacent to the supports 134, 136 and the adjustable support 140 are formed with a rabbet. The tape measures 223, 225 are located in respective rabbets so that they are recessed from the upper surface of the work top 132, out of engagement with any wall frame elements and the offset locators 205, 207. One end of each tape measure 223, 225 is aligned with the inner face 138A, 238A of its corresponding end stop 138, 238 and indicates distances from the respective inner face along the table 110. In the illustrated embodiment, the tape measures 223, 225 are each received in a shallow channel 226 (FIG. 13) which is secured to the table 110. It is to be understood that a reference rule could be provided by other than a tape measure mounted on the table 110 without departing from the scope of the present invention. For instance, graduations could be marked on or scored into the work top material along the length of the table 110. In addition, it is envisioned that the tape measures on the table 110 could be used to position the locating fingers 213 of respective offset locators, rendering the separate tape measure 217 on the base 209 unnecessary. In that event, the "rule" and the "reference rule" would be the same structure.

Figure 12:
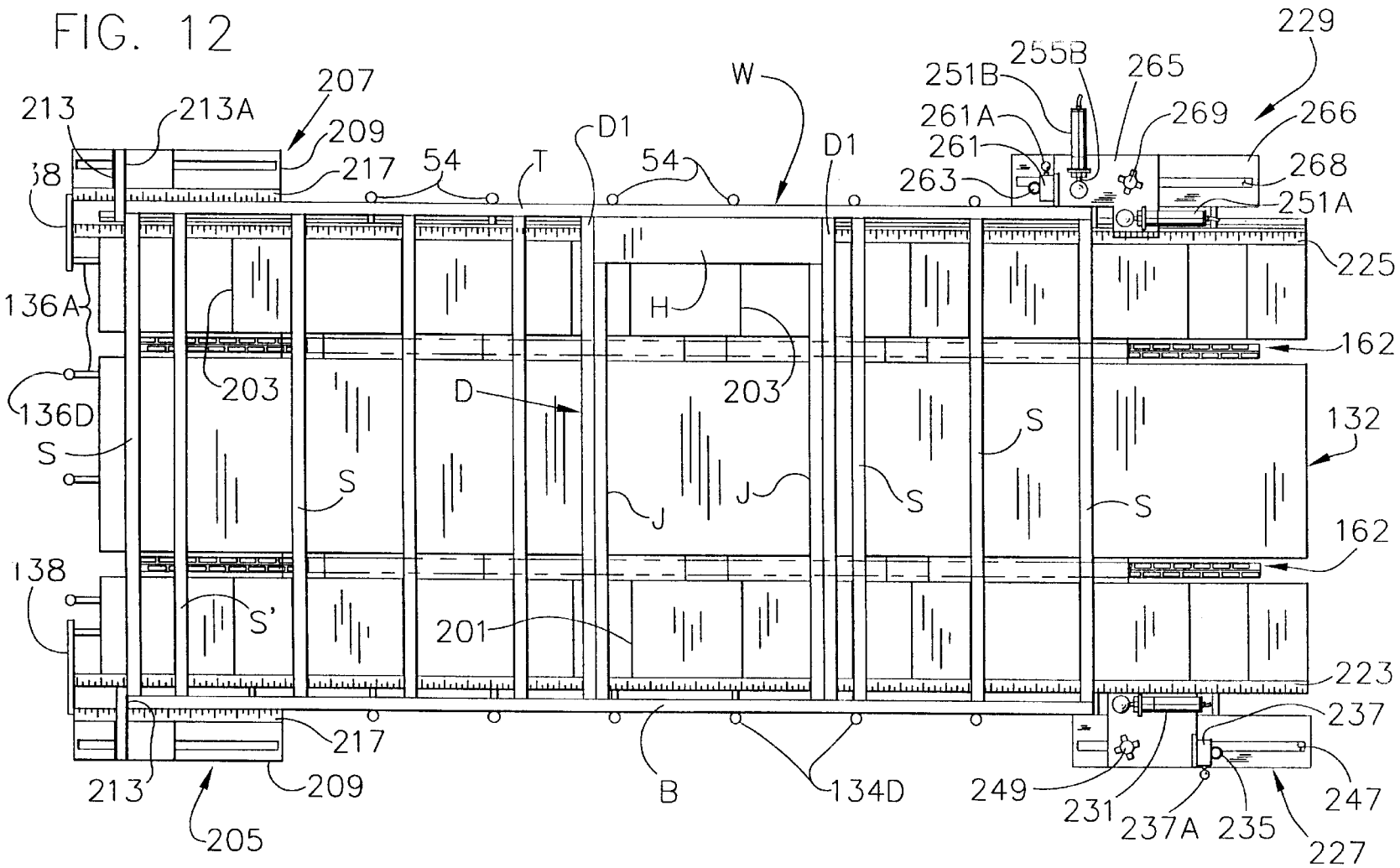
FIG. 12 is a top plan similar to FIG. 10 but shows a wall frame on the table.
Figure 13:
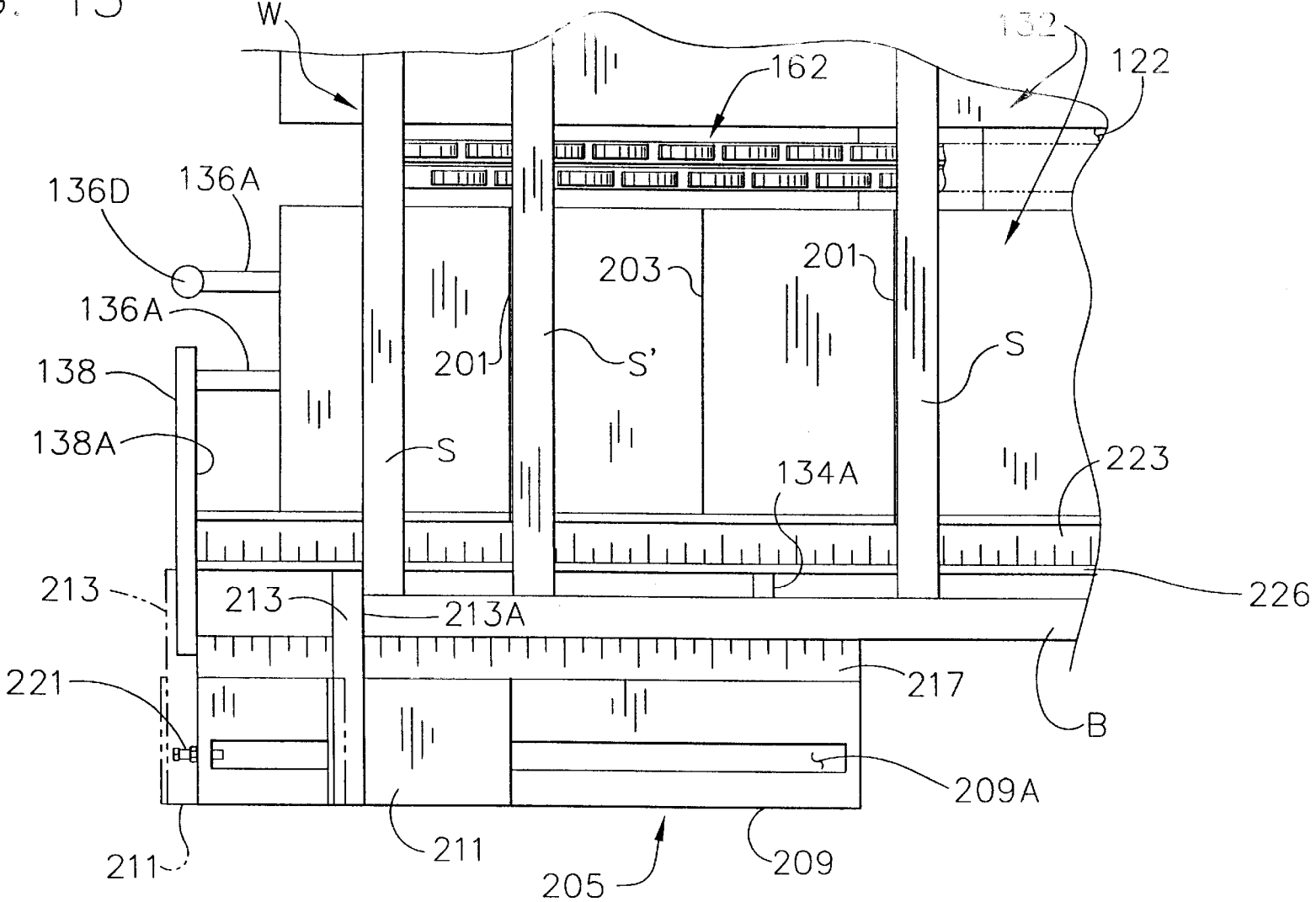
FIG. 13 is an enlarged, fragmentary top plan of a corner of the table of FIG. 10 showing an offset locator.

Referring now to FIG. 12, the wall frame assembly table 110 is shown with a wall frame W assembled thereon. The top and bottom plates T, B, and left end stud S are located laterally by engagement with the locating fingers 213 of the offset locators 205, 207. The top and bottom plates T, B are also located by their engagement with the pins 154, 134D, respectively, substantially as described for the first embodiment. The pins 154, 134D and offset locators 205, 207 generally provide adequate location of the wall frame elements. However, the wall frame W typically lacks rigidity in its plane, even after the studs S are secured to the top and bottom plates T, B. Moreover, it is not difficult for the studs S to become angled slightly between the top and bottom plates T, B, producing a wall frame which is not square (i.e., having the form of a parallelogram rather than a rectangle). One known way to improve the rigidity and rectangular shape of the finished wall frame is to secure as by nailing plywood sheets (not shown) over the wall frame. However, it is difficult to hold the wall frame W in a squared configuration while the plywood is being secured to the frame, causing the wall frame to assume a parallelogram shape even with the plywood attached to the frame.

Figure 15:
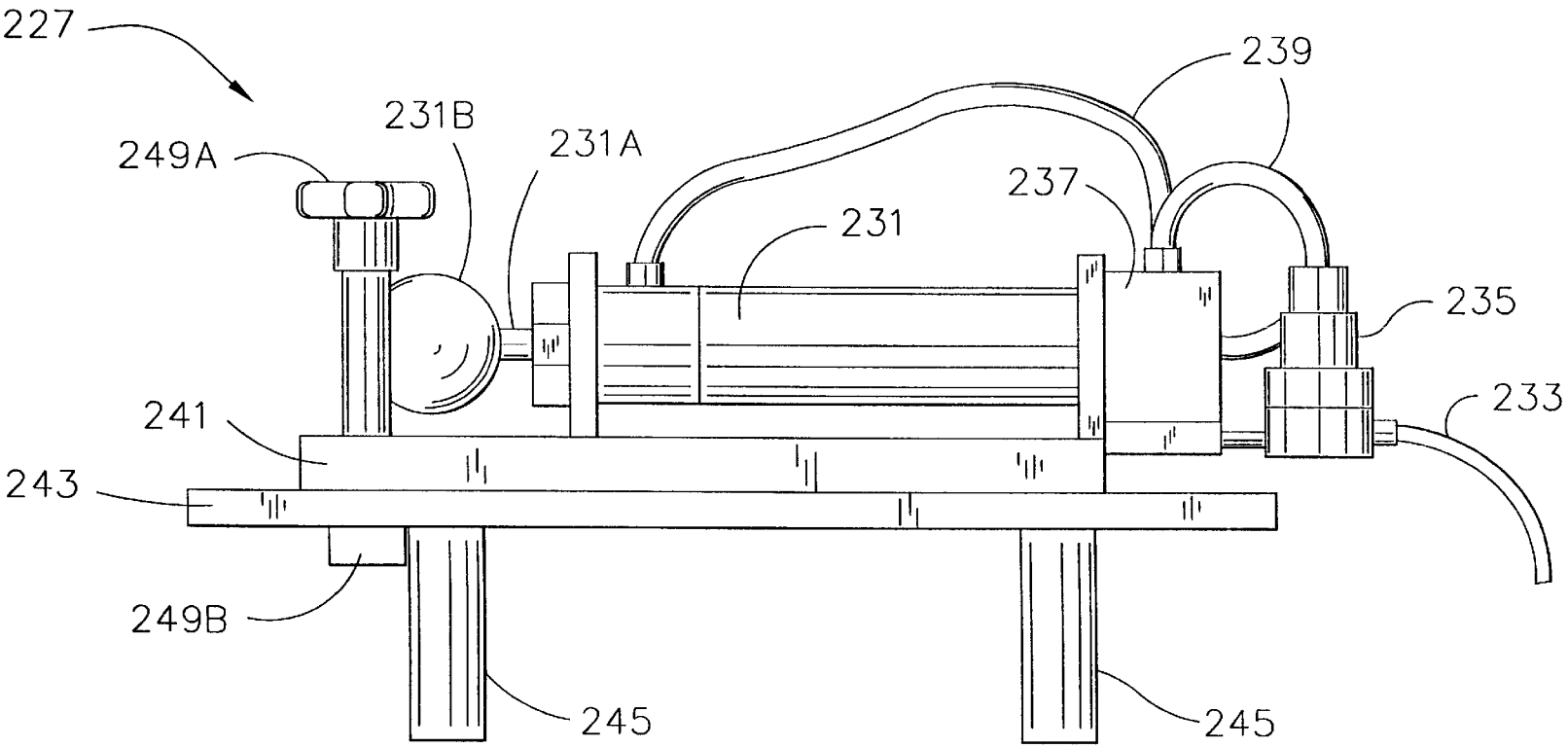
FIG. 15 is an elevation of a clamp cylinder unit for use with the wall frame assembly table of the first or second embodiments.

Accordingly, squaring clamp units are provided as shown in FIG. 12 to hold the wall frame W in a rectangular configuration. The squaring clamp units include a first clamp unit 227 located at the lower right end of the wall frame W and a second, double clamp unit 229 located at the upper right end of the wall frame. As shown in FIG. 15, the first clamp unit 227 includes one double acting cylinder 231 having a cylinder rod 231 A with a ball 231B at its terminal end. The cylinder 231 is connected to a source of compressed air by a tube 233 extending through a pressure regulator 235 to a valve 237. Lines 239 extend from the valve 237 to opposite ends of the cylinder 231. A lever 237A (FIG. 12) on the valve may be moved to actuate the cylinder 231 between an extended position in which the ball 231B engages the wall frame W and urges it to the left against the offset locator 205, and a retracted position in which the clamping force on the wall frame is released. The cylinder 231 is mounted by a slide 241 on a base 243 similar to the side 211 and base 209 of the offset locator 205. The base 243 includes a pair of legs 245 which are received in tubes 134C of the supports 134 in place of the pins 134D to connect the first clamp unit 227 to the table 110. The slide 241 is mounted in a slot 247 in the base 243 for movement longitudinally of the slot, parallel to the adjacent edge of the work top 132 for positioning relative to the lower right end of the wall frame W. A set knob 249 which turns a bolt (not shown) received in a nut 249B on the bottom side of the base 243 is provided to clamp the slide 241 to the base 243 in the selected position and to oppose any reaction force from the wall frame W when the cylinder 231 is extended.

Figure 16:
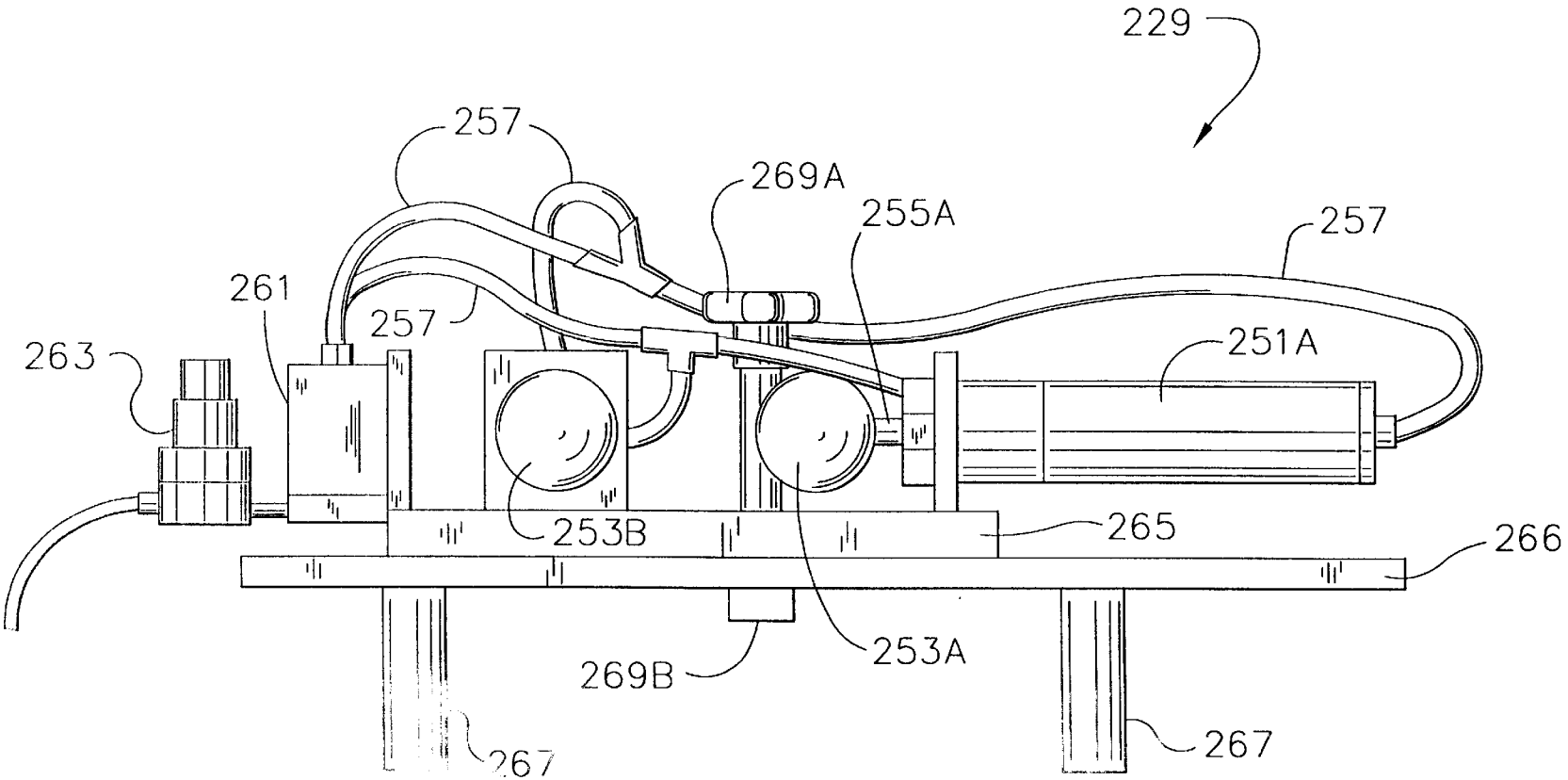
FIG. 16 is an elevation of a double clamp cylinder unit for use with the wall frame assembly table of the first or second embodiments.

The second, double clamp unit 229 is shown in FIG. 16 to comprise two cylinders 251A, 251B (only one is shown in FIG. 16) arranged at right angles to each other. The cylinders 251A, 251B each have a ball 253A, 253B mounted on a terminal end of a cylinder rod 255A, 255B for engaging a wall frame element. The cylinders 251A, 251B are connected by lines 257 to a valve 261 having a lever 261A (FIG. 12) which can be moved to simultaneously operate the cylinders to extend or retract. The valve 261 is connected through a pressure regulator 263 to the source of compressed air used for the first clamp unit 227. A slide 265 of the second clamp unit 229 is generally L-shaped and mounts both of the cylinders 251A, 251B to a base 266 having legs 267 received in tubes 54 of the adjustable support 140. As before, a portion of the slide 265 is received in a slot 268 (FIG. 12) in the base 266 for sliding movement along the length of the slot. A set knob 269A is connected by a bolt (not shown) to a nut 269B to selectively clamp the slide 265 in position on the base 266. The cylinder 251A arranged parallel to the adjacent edge of the work top 132 acts when extended to force the wall frame W to the right against the offset locators 205, 207. The other cylinder 251B engages the top plate T to force the wall frame W against the pins 134D supporting the bottom plate B. Acting in cooperation, the first and second clamp units 227, 229 hold the wall frame W in a squared configuration as plywood or another covering is secured to the wall frame.

Figure 17:
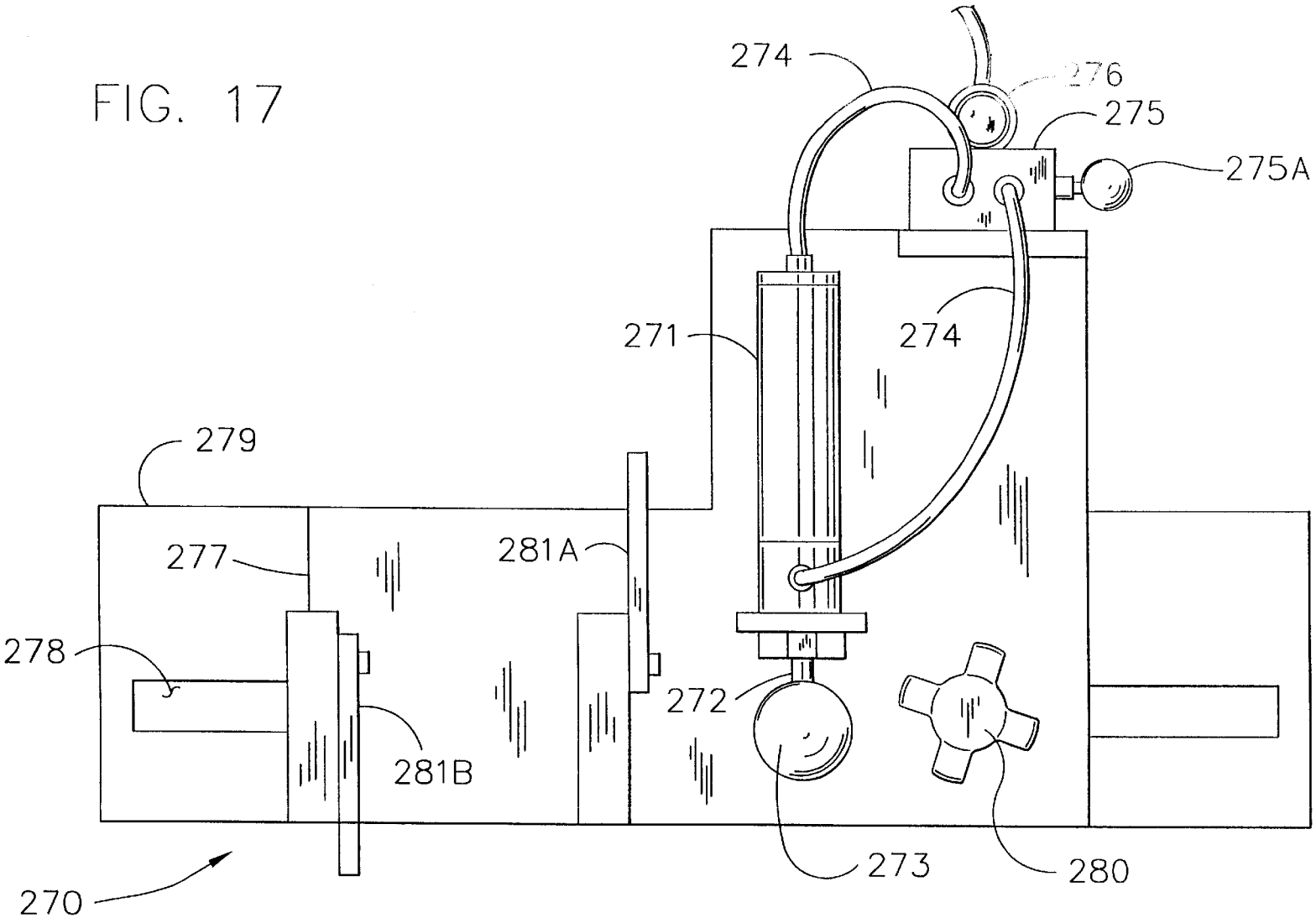
FIG. 17 is a top plan of a clamp cylinder unit having plate locating fingers.

A third clamp unit shown in FIG. 17 is designated generally at 270. The third clamp unit is capable of being used in place of one of the offset locators 205, 207. In a preferred embodiment, the third clamp unit 270 replaces the offset locator 207 at the top left corner of the table 110. It is envisioned that the clamp unit 270 and offset locator 207 could be used in conjunction (i.e., side-by-side) or combined into a single operating unit (not shown) without departing from the scope of the present invention. The third clamp unit 270 includes a cylinder 271 having a cylinder rod 272 and ball 273 just like the cylinders 231, 251 of the first and second units 227, 229. The cylinder 271 is connected by lines 274 to a valve 275 connected to the source of compressed air through a pressure regulator 276. The valve 275 includes a lever 275A for operating the cylinder 271. In an extended position of the rod 272, the cylinder 271 urges the wall frame W against the pins 134D supporting the bottom plate B. A slide 277 includes a portion received in a slot 278 of a base 279 for sliding movement of the slide and cylinder 271 mounted thereon along the length of the base parallel to the edge of the work top 132. A set knob 280 is attached to a nut (not shown) on the underside of the base 279 for clamping the slide 277 in fixed position relative to the base 279. The base is attached to the table 110 in the same way as the bases 243, 266 of the first and second clamp units 227, 229.

The third clamp unit 270 further includes two pivoting locator fingers 281A, 281B capable of performing the function of the offset locating fingers 213 when the third clamp unit is used in place of the offset locator 207. When not in use, either or both fingers 281A, 281B can be pivoted backward, as illustrated in FIG. 17 for the finger 281A. The other finger 281B extends beyond the edge of the slide 277 for engaging the left end of the top plate T. Alignment can be achieved by using the tape measure 225 along the top edge of the table 110 to position the end of the top plate T and the finger 281A can be moved into engagement at this position by sliding the slide 277 along the base 279 and securing the slide in position. The provision of two fingers 281A, 281B allows for a greater range of possible positions for the left end of the top plate T which can be located by the third clamp unit 270.

Figure 11:
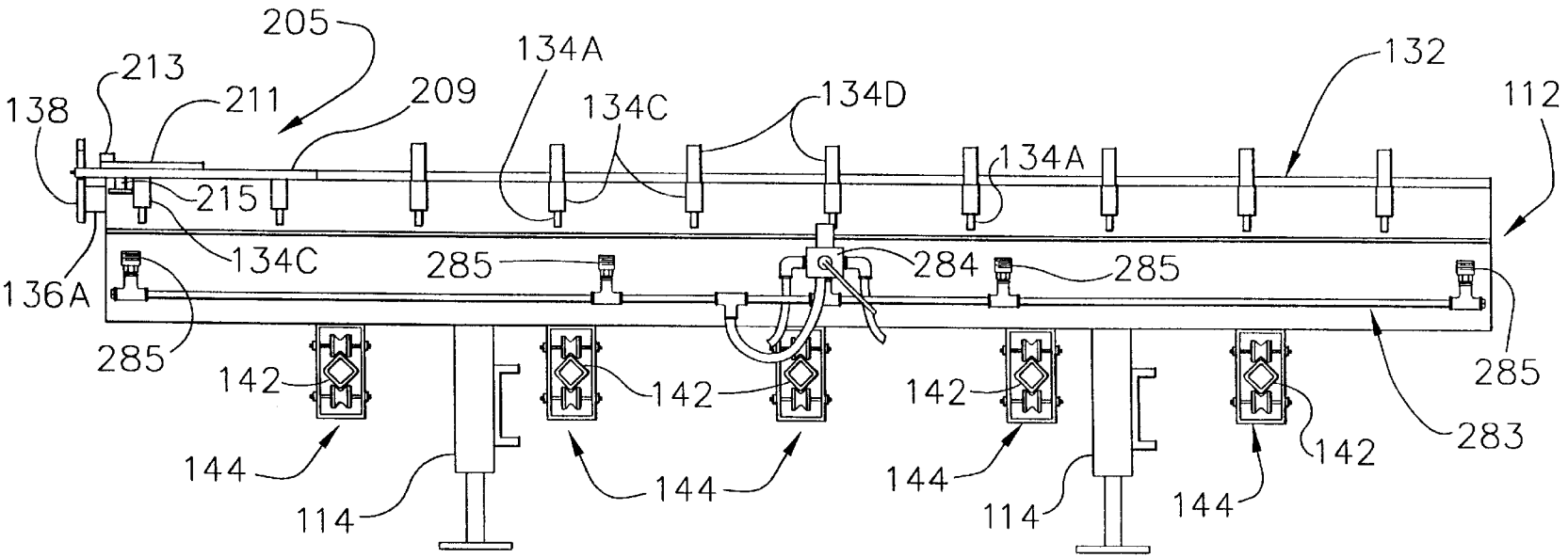
FIG. 11 is a side elevation of the table of FIG. 10.

Delivery of the compressed air to the clamp units is provided by piping (generally indicated at 283) mounted on the table 110. As shown in FIG. 11, the piping 283 includes a valve 284 and several fittings 285 adapted for connection of a clamp unit (227, 229, 270) to the piping at different locations along the length of the table 110. It is also envisioned that the fittings 285 could be used for attachment of pneumatic nail guns (not shown) used to fasten the studs S to the top and bottom plates T, B. The piping 283 is adapted for connection to a source of compressed air which is remote from the table 110. A similar arrangement of pipe and fittings (not shown) are disposed on the opposite side of the table 110 from that shown in FIG. 11.

Having described the structure of the table 110 of the second embodiment, its use for assembling a wall frame W will now be explained. Preferably, the wall frame W will have been designed using appropriate design software, such as MiTek PanelBuilder™ software available from MiTek Industries, Inc. of St. Louis, Mo. The software as loaded into a suitable microprocessor 286 ("logic circuit") and is capable of arranging the elements of wall frames needed from the dimensions of the structure. Windows, doorways or other openings can be selected for insertion by the software at desired locations. The software stores the relative positions of the studs in each wall frame formed by the software. For the present invention, the software has been modified in order to produce a printout of the locations of the offset locators 205, 207, the studs S and any other features (e.g., doorways, windows) which are part of the wall frame. In particular, the software finds the position of the first stud from the left end of the wall frame W. If the distance is less than the standard stud spacing interval (e.g., 16 inches), an offset is calculated equal to the difference of the actual spacing between the end of the wall frame and the first stud, and the standard spacing. For example and with reference to FIG. 12, the first stud S' is spaced to the right of the left end of the wall frame W about 6 inches. The difference between this spacing and the standard 16 inch stud spacing for this wall frame is 10 inches. Accordingly, the software generates an offset location of 10 inches. The location of a doorway D is also generated by the software. Uniquely, the software converts the location of the doorway D relative to the ends of the wall frame W to a location which is indicated by the tape measures 223, 225 from the end stops 138, 238 of the table 110. This is accomplished by adding the offset amount (10 inches) to the location of the doorway D from the left end of the wall frame W. All of this information is provided in the form of a readout, which preferably is printed so that the laborer can take it with him as he assembles the elements of the wall frame W.

The laborer will previously have attached the offset locators to the table 110. The knob 215 of the offset locator 205 is turned to loosen its grip on the base 209, permitting the slide 211 to move along the slot 209A to a location between the end stop 138 and the nearest stud locator groove 201. The slide 211 is moved until the inner face 213A of the locating finger 213 is aligned with 10 inches on the tape measure 217 attached to the base 209. The knob 215 is turned to fix the offset locator 205 in this position. The same procedure is performed for the other offset locator 207 so that both are positioned at the same (10 inch) offset. The wall frame W shown in FIG. 12 is of standard eight foot height so that the adjustable support 140 is fixed (by actuation of the air brakes 58) in its fully retracted position, immediately adjacent to the upper edge of the work top 132. The bottom plate B is placed onto the supports 134 against the pins 134D and with its left end abutting the locating finger 213 of the offset locator 205.

The studs S which are needed are placed in alignment with the stud locator grooves 201 without the need to measure from offset locator or end stop, and even without reference to the tape measures 223, 225 on the table 110. The grooves 201 permit not only the correct spacing of the studs S but facilitate orientation of the studs perpendicularly to the top and bottom plates T, B. The printout will indicate which studs are omitted to permit placement of the doorway D. The doorway D includes side elements D1, a header H and jacks J. Although the components of the doorway D may be separately inserted onto the table 110, it is common to pre-assemble the doorway and drop the subassembly into the wall frame W. The printout will indicate with reference to the tape measures 223, 225 on the table 110 the location of the left edge of the doorway D so that the laborer may properly position the doorway by alignment with the indicated mark on the tape measures. The studs S and doorway D are secured to the top and bottom plates T, B by driving nails, such as with a nail gun, through the top and bottom plates and into the studs S and components of the doorway D. As explained above with respect to the first embodiment, any pins 134D, 154 which interfere with the driving of the nails can be removed without loss of overall support of the top or bottom plate T, B. The top plate T is placed on the adjustable support 140 between the upper ends of the stud S and doorway D and the pins 154. However, the order the wall frames elements are placed on the table 110 may be other than described without departing from the scope of the present invention.

Once the wall frame elements (T, B, S, D) are secured together, one or more pieces of plywood may be fastened over the wall frame W to add strength and rigidity in the plane of the wall frame. In order to hold the wall frame W square while the plywood is connected, the first and second clamp units 227, 229 are employed. Each unit is attached to the table 110 by inserting legs 245, 267 on the bottom of their respective bases 243, 266 into corresponding tubes (134C and 56, respectively). The set knobs 249, 269 are loosed to permit the slides 243, 266 and cylinders 231, 251 mounted thereon to move along the table 110 generally adjacent to the right end of the wall frame W. The set knobs 249, 269 are tightened down to secure the first and second clamp units 227, 229 in fixed positions relative to the work top 132 of the table 110. The valve 235, 261 is actuated to extend the rods 231A, 255 of the cylinders so that the balls 23 1B, 253 engage the wall frame W. The cylinders 231, 251 force the wall frame into a rectangular configuration for application of the plywood. Once the plywood is secured as by nailing to the wall frame W, the cylinders 231, 251 are released and the plywood holds the wall frame in the rectangular configuration for shipping to the construction site. The completed wall frame W can be removed from the table 110 by activation of the ejectors 162, in the same fashion as the first embodiment.

As stated above, one of the offset locators 205 or 207 could be replaced by the third clamp unit 270 (not shown in FIG. 12) to provide for additional force on the wall frame W to hold it in a rectangular configuration. The balls 231B, 253 of the cylinders 231, 251 allow a uniform area of engagement with the wall frame elements. Although the adjustable support 140 is retracted in FIG. 12, the angle iron 146 may be extended and angled (e.g., to form wall frame W''' shown in FIG. 18C) without affecting the use of at least one offset locator 205. If the angle iron 146 is positioned at an angle, the offset locator 207 along the top edge of the table 110 should preferably be replaced, relying on the other offset locator 205 to provide the proper location of the left end of the top plate T.

Figure 18A:
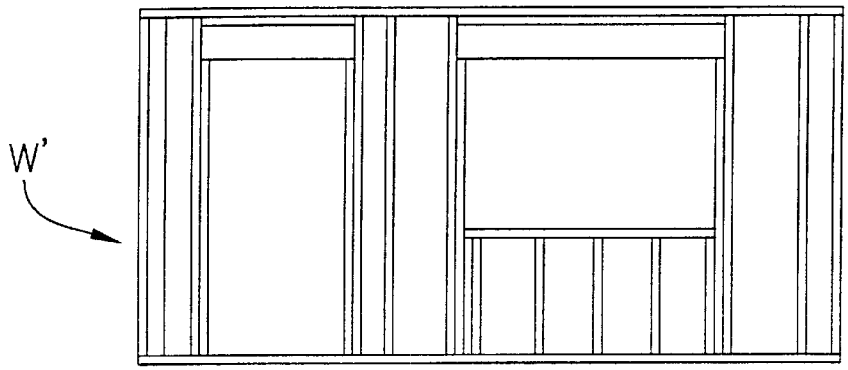
FIGS. 18A–18C show wall panels of different configurations which may be assembled using the wall frame assembly tables of the present invention.
Figure 18B:
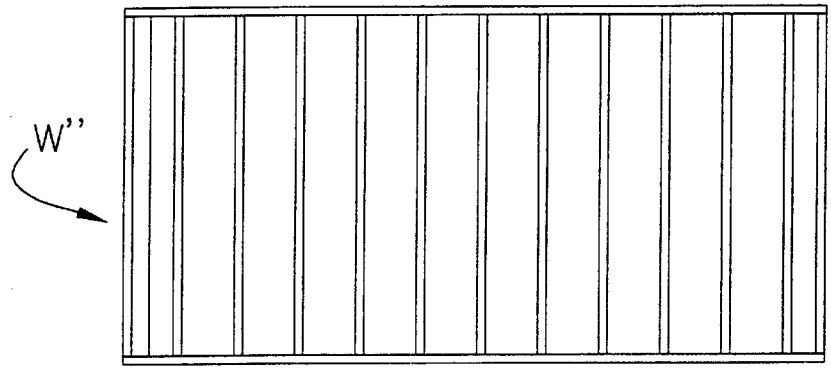
Figure 18C:
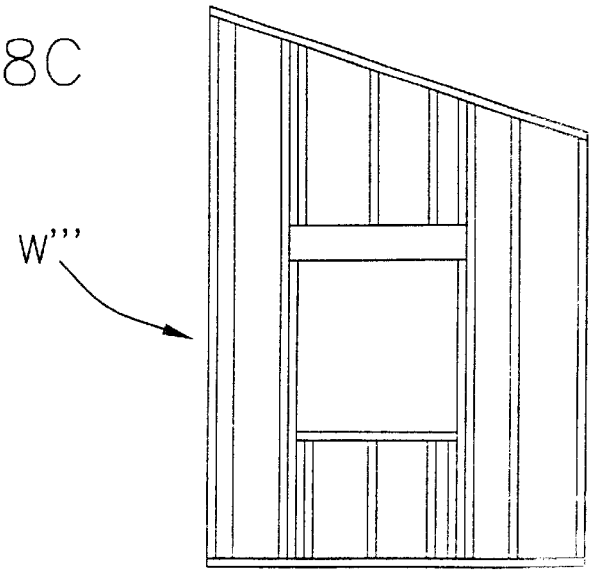

Wall frames of many different configurations can be manually set up and assembled with the table 110 and method of the present invention. Other typical wall frames, designated W', W'' and W''', respectively, are illustrated in FIGS. 18A–18C. These include door and window openings of different shapes and sizes, as well as a sloped top plate such as used for constructing a cathedral ceiling or the like. If the adjustable support 140 is to be angled, it is pulled out some distance from the upper edge of the work top 132 prior to placement of the bottom plate B and studs S. The position of the adjustable support 140 may be established by the elements of the wall frame. The support 140 is moved out and angled until the top plate T will fit between the upper ends of the studs S and the pins 154. It is envisioned that one or more of the rails 142 of the adjustable support could be marked or carry a tape measure to facilitate their placement when extended from the edge of the work top.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A table for assembling wall frames comprising a frame, at least one panel defining a work top supported by the frame and adapted to support wall frame elements thereon, the work top having a peripheral edge, and wall frame element supports extending outwardly from the peripheral edge of the work top, the supports being sized to support wall frame elements thereon adjacent to the work top, the supports being spaced apart whereby debris in the region of the work top peripheral edge can fall between the supports and is inhibited from accumulating on the supports.

2. A table as set forth in claim 1 wherein the supports comprise pins removable from the support for exposing a laterally outwardly facing region of a wall frame element.

3. A table as set forth in claim 1 further comprising an adjustable support adapted for movement relative to the peripheral edge of the work top, the adjustable support being mounted on the frame for movement toward and away from the peripheral edge and for angulation with respect to the peripheral edge.

4. A table for assembling wall frames and the like comprising a frame, a work top supported by the frame and adapted to support wall frame elements thereon, the work top having a peripheral edge, an adjustable wall frame element support located laterally outwardly from the peripheral edge, the adjustable support being adapted to support wall frame elements and being mounted on the frame for movement toward and away from the peripheral edge and for angulation with respect to the peripheral edge for assembling wall frames of different configurations.

5. A table for assembling wall frames comprising a frame, a work top supported by the frame and adapted to support wall frame elements thereon, the work top having a peripheral edge, and wall frame element supports extending outwardly from the peripheral edge of the work top, the supports being sized to support wall frame elements thereon adjacent to the work top, the supports being spaced apart whereby debris in the region of the work top peripheral edge can fall between the supports and is inhibited from accumulating on the supports wherein the wall frame elements include a top plate, a bottom plate and studs extending between and interconnecting the top and bottom plates, and wherein the table further comprises:

a reference locator mounted on the table in a fixed position relative to the work top;

stud locator markings on the work top positioned at intervals along the top from the reference locator;

an offset locator adapted to be selectively secured at different locations generally along an edge margin of the work top and engageable with a longitudinal end of one of the top and bottom plates for locating an end of the wall frame in a position offset from the reference locator a distance spaced from the reference locator which is selected to locate an end of the wall frame to permit placement of studs in the wall frame at the stud locator markings without measurement from the reference locator.

6. A table for assembling wall frames comprising a frame, a work top supported by the frame and adapted to support wall frame elements thereon, the work top having a peripheral edge, an adjustable wall frame element support located laterally outwardly from the peripheral edge, the adjustable support being adapted to support wall frame elements and being mounted on the frame for movement toward and away from the peripheral edge for assembling wall frames of different configurations wherein the wall frame elements include a top plate, a bottom plate and studs extending between and interconnecting the top and bottom plates, and wherein the table further comprises:

a reference locator mounted on the table in a fixed position relative to the work top;

stud locator markings on the work top positioned at intervals along the top from the reference locator;

an offset locator adapted to be selectively secured at different locations generally along an edge margin of the work top and engageable with a longitudinal end of one of the top and bottom plates for locating an end of the wall frame in a position offset from the reference locator a distance spaced from the reference locator which is selected to locate an end of the wall frame to permit placement of studs in the wall frame at the stud locator markings without measurement from the reference locator.

7. A table as set forth in claim 6 further comprising a rule positioned relative to the work top and the reference locator for indicating the position of the offset locator relative to the reference locator for accurately positioning the offset locator.

8. A table as set forth in claim 6 further comprising a reference rule positioned for indicating positions along the work top from the reference locator.

9. A table as set forth in claim 6 wherein the offset locator comprises a first offset locator and wherein the table further comprises a second offset locator adapted to be selectively secured at different locations generally along an edge margin of the work top opposite the edge margin where the first offset locator is disposed, the second offset locator being engageable with a longitudinal end of the other of the top and bottom plates for locating an end of the wall frame in a position offset from the reference locator a distance spaced from the reference locator which is selected to locate an end of the wall frame to permit placement of studs in the wall frame at the stud locator markings without measurement from the reference locator.

10. A table as set forth in claim 6 further comprising a squaring clamp adapted for mounting on the table, the squaring clamp being operable to engage the wall frame for urging the studs into generally right angle relationship with the top and bottom plates.

11. A table as set forth in claim 6 wherein the stud locator markings comprise lines in the work top extending generally transversely of the table.

12. A table for assembling wall frames comprising a frame, a work top supported by the frame and adapted to support wall frame elements thereon, the work top having a peripheral edge, an adjustable wall frame element support located laterally outwardly from the peripheral edge, the adjustable support being adapted to support wall frame elements and being mounted on the frame for movement toward and away from the peripheral edge for assembling wall frames of different configurations, said table further comprising wall frame element supports extending outwardly from the peripheral edge of the work top, the supports being sized to support wall frame elements thereon adjacent to the work top, the supports being spaced apart whereby debris in the region of the work top peripheral edge can fall between the supports and is inhibited from accumulating on the supports.

13. A table as set forth in claim 12 wherein the supports comprise pins removable from the supports for exposing a laterally outwardly facing region of a wall frame element.

14. A table as set forth in claim 4 wherein the adjustable wall frame support element is attached to at least one rail slidable mounted on the table for selective extension and retraction relative thereto.

15. A table as set forth in claim 14 wherein the wall frame support element is pivotally attached to the rail.

16. A table as set forth in claim 15 further comprising multiple rails pivotally attached to the wall frame support element mounting the wall frame support element on the table for extension and retraction relative to the table.

17. A table as set forth in claim 16 further comprising a rail guide for each rail, each rail guide including bogies mounting the rail for sliding movement relative to the table.

18. A table as set forth in claim 16 further comprising a lock for locking the adjustable wall frame support in a fixed position relative to the table.

19. A table as set forth in claim 16 wherein the lock comprises at least one air brake engageable with at least one of the rails for locking the rail in position.

20. A table for assembling wall frames comprising a frame, a work top supported by the frame and adapted to support wall frame elements thereon, the work top having a peripheral edge, an adjustable wall frame element support located laterally outwardly from the peripheral edge, the adjustable support being adapted to support wall frame elements and being mounted on the frame for movement toward and away from the peripheral edge for assembling wall frames of different configurations, wherein the wall frame support element comprises a unitary piece.

21. A table for assembling wall frames comprising a frame, a work top supported by the frame and adapted to support wall frame elements thereon, the work top having a peripheral edge, an adjustable wall frame element support located laterally outwardly from the peripheral edge, the adjustable support being adapted to support wall frame elements and being mounted on the frame for movement toward and away from the peripheral edge for assembling wall frames of different configurations, said table further comprising a lock for locking the adjustable wall frame support in a fixed position relative to the table.

* * * * *